United States Patent [19]

Borden

[11] 4,315,464

[45] Feb. 16, 1982

[54] TAMPER TIP FOR RAILROAD TIE TAMPING MACHINES

[76] Inventor: Walter S. Borden, P.O. Box 866, Racine, Wis. 53403

[21] Appl. No.: 53,856

[22] Filed: Jul. 2, 1979

Related U.S. Application Data

[63] Continuation of Ser. No. 834,230, Sep. 19, 1977, abandoned.

[51] Int. Cl.[3] ..... E01B 27/13

[52] U.S. Cl. ..... 104/10; 37/142 R

[58] Field of Search ..... 104/10–14; 37/141 R, 141 T, 142 R; 404/133; D12/49, 51; D15/29; 81/52.3, 52.35

[56] References Cited

U.S. PATENT DOCUMENTS

| | | | |
|---|---|---|---|
| 759,359 | 5/1904 | Ferguson | 104/13 |
| 1,395,048 | 10/1921 | McKee | 37/142 R |
| 3,971,323 | 7/1976 | Beiswenger | 104/10 |
| 4,006,544 | 2/1977 | Stepe | 37/141 T |
| 4,231,173 | 11/1980 | Davis | 37/142 R |

*Primary Examiner*—Randolph A. Reese

*Attorney, Agent, or Firm*—Wegner, Stellman, McCord, Wood & Dalton

[57] ABSTRACT

This invention provides a tamper tip for use with tamping machines for setting railroad ties. The tip is generally rectangular in shape and at least one surface is provided with a generally U-shaped outer edge portion which increases in thickness from the tips of the legs of the "U" to the base of the "U" with the portion interior of the "U" being shaped to a constant thickness generally equal to the thickness of the thinnest portion of the legs.

4 Claims, 3 Drawing Figures

TAMPER TIP FOR RAILROAD TIE TAMPING MACHINES

CROSS-REFERENCE

This application is a continuation of my copending application Ser. No. 834,230 filed Sept. 19, 1977, entitled "Tamper Tip for Railroad Tie Tamping Machines" now abandoned.

BACKGROUND OF THE INVENTION

Tamping devices for setting railroad ties have been in use for a considerable number of years. The apparatus generally consists of a car mounted on railroad wheels and which is provided with eight pairs of tampers, which comprise vertically mounted shafts carrying a tamper tip at their lower ends with the shafts being mounted for rotational as well as vibratory movement. In operation, the shafts are lowered so as to engage the tamper tips with the rocks and ballast on either side of a tie and then as the shafts are rotated or oscillated through a few degrees and vibrated, they are slowly pushed into the ballast and operate to squeeze or force the ballast under the tie to set it at the proper level.

Ballast used in railroad ties differ widely in characteristics, some being quite sandy and others comprising mostly rock. As can be expected, the tips wear out quite rapidly because of the rather rigorous method in which they are used. The normal construction of the tamper tip is a generally wedge-shaped piece of metal having its narrowest edge at the bottom for easier penetration into the ballast.

As the tip wears, the bottom portion becomes wider and wider, and thus in effect becomes more and more difficult to insert into the ballast. For this reason, replacement of the tamper tips is required at rather frequent intervals and replacement involves the cutting off, as by an acetylene torch, of the tip and welding a new tip onto the tamper shaft.

SUMMARY OF THE INVENTION

The present invention provides a tamper tip which, because of its design, can be considered self-sharpening and thus may be used for a considerably longer period of time than the tamper tips presently in use. For this purpose, the tamper tip has an outer edge portion generally in the shape of an inverted "U" which is wedge-shaped as were the entire tamper tips heretofore used. The central portion of the tamper tip, i.e., the portion interior of the "U", is not tapered but rather has a constant thickness. The thickness of the inner portion is equal to the thickness of the leading edges of the legs of the "U" and thus even though the metal wears away in use, the exposed edge of the inner portion is of the same thickness and thus retains its ability to penetrate the ballast. The provision of the inverted U-shaped portion which is tapered, gives the strength and stability needed in a tool such as a tamper tip, and the combination with the constant thickness inner portion results in a tamper tip which may be used without replacement for a considerably longer period of time than those presently employed.

DESCRIPTION OF THE PREFERRED EMBODIMENT

Figure 1:
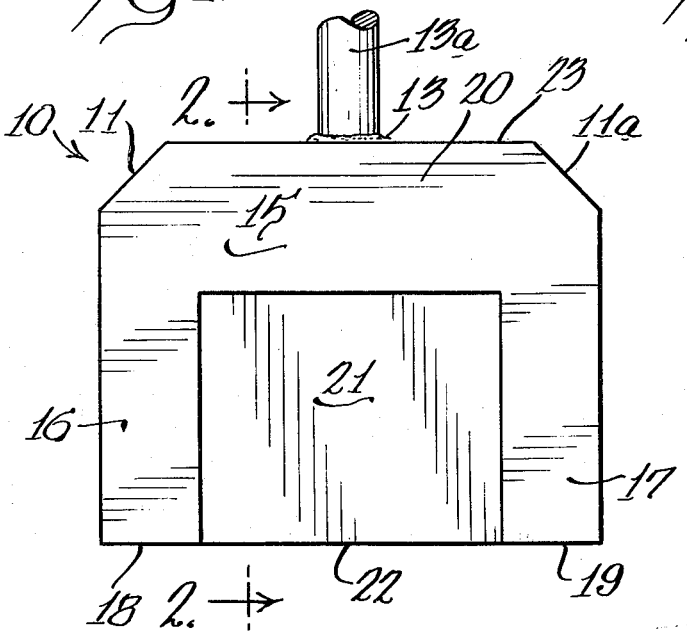
FIG. 1 is a front elevational view of a tamper tip made in accordance with the present invention.
Figure 2:
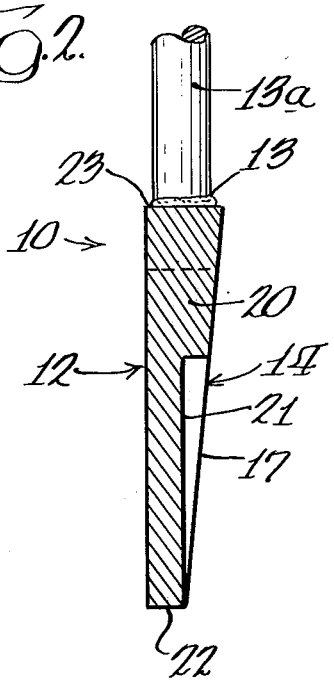
FIG. 2 is a sectional view taken along line 2—2 of FIG. 1.

Referring now to FIGS. 1 and 2 of the drawings, there is shown a tamper tip 10 of generally rectangular shape. The entire tamper tip is made of abrasion resistant metal, such as for example a boron chromium steel or a boron molybdenum steel. The upper corners 11 and 11*a* of the tip are beveled as shown, and the entire tip has a planar back 12.

As previsouly indicated, the tip is to be secured to a shaft which in turn is oscillated and vibrated to effect the tamping operation heretofore described. To this end the tip is secured as by weld 13 to the shaft 13*a* of a tamping machine.

The front surface 14 of the tip has an outer integral portion in the shape of an inverted "U" 15 having legs 16 and 17 terminating in leading edges 18 and 19. At the upper portion of the tip is the base 20 of the "U".

Between the legs of the "U" 15 and integrally formed therewith is an inner portion 21 having an exposed edge 22 of the same thickness as the leading edges 18 and 19 and contiguous therewith. Thus, the edges 18, 19 and 22 present a single continuous edge of uniform thickness extending from side to side of the tamper tip. The top portion 23 of the tamper tip is flat to provide for simplicity and ease in welding the shaft 13*a* to the tamper tip.

Tamper tips are normally made in sizes (measured from top to bottom) of 3 inches and 4 inches. In the 3 inch version of my invention, the thickness of the leading edge formed by the portions 18, 19 and 22 is preferably $\frac{3}{8}$ in. (plus or minus 1/16 in.), and tapered to a thickness at the top portion 23 of $\frac{5}{8}$ in. (plus or minus 1/16 in.). In the 4 inch version, the leading edge portions are the same as in the 3 inch version, but the top portion 23 has a thickness of $\frac{3}{4}$ in. (plus or minus 1/16 in.). The overall width of the tamper tip is 5 inches (in both sizes), and the width of each leg 16 and 17 is 1 inch ( in both sizes).

Figure 3:
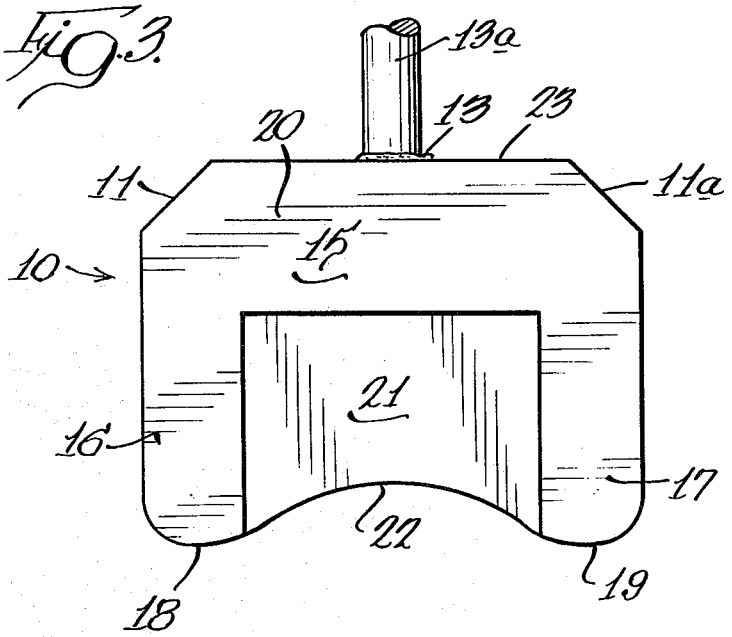
FIG. 3 is a view like FIG. 1 showing the tamper tip after a period of use.

When the tamper tip is used to tamp ballast around railroad ties for the purpose of setting the ties and assuring that ballast supports the bottom edge of the ties, a considerable amount of wear takes place which, in devices heretofore used, would cause the leading or penetrating edge of the tamper tip to become thicker and thicker until the point was reached that penetration became virtually impossible. When the tamper tip of the present invention is used however, wear takes place without widening or blunting the leading or penetrating edge of the device. Thus, as shown in FIG. 3, after the device has been in use for some time the leading edges 18 and 19 of the "U" will be worn off somewhat as shown while the leading edge 22 of the inner portion 21 is worn to a greater degree. Thus, the combination of leading edges 18, 19 and 22, when the device has been used to produce the wear illustrated in FIG. 3, will assume the shape as shown but the major portion, i.e., the portion 21, is still of its original thickness and thus penetrates with the same ease as when new. At the same time, the tapered U-shaped portion provides the necessary overall strength to the tamper tip and a means for firmly securing it to the shaft 13*a*.

Thus, in the device of the present invention there is provided a tamper tip substantially equal in strength to those heretofore used and, in addition, one which can be used for a considerably longer period of time because the major portion of the penetrating edge, i.e., the portion 21, does not "dull" by becoming wider as was the case heretofore. Thus, the apparatus of the present invention is in effect self-sharpening.

I claim:

1. A tamper tip of abrasion-resistant metal said tamper tip being of generally rectangular shape and having a front surface having an outer generally inverted U-shaped portion having legs tapering from thinner leading edge portions to a thicker top portion forming the base of the "U" with the top of said base forming the top of the tamper tip, an integral inner portion completely filling the interior part of the U-shaped portion, said inner portion having an exposed edge contiguous with and having the same thickness as the leading edges of the legs to provide a continuous edge of constant thickness, with the length of said continuous edge being greater than the distance from said continuous edge to the top of the tamper tip, and with said inner portion being of substantially constant thickness throughout its extent, said tamper tip having a planar back surface extending from said continuous edge to the top of the tamper tip and with said exposed edge of the inner portion comprising not more than 60 percent of the length of said continuous edge.

2. A tamper tip of abrasion-resistant metal said tamper tip being of generally rectangular shape and having a front surface having an outer generally inverted U-shaped portion having legs tapering from thinner leading edge portions to a thicker top portion forming the base of the "U" with the top of said base forming the top of the tamper tip, an integral inner portion completely filling the interior part of the U-shaped portion, said inner portion having an exposed edge contiguous with and having the same thickness as the leading edges of the legs to provide a continuous edge of constant thickness and with said inner portion being of substantially constant thickness throughout its extent, said tamper tip having a planar back surface extending from said continuous edge to the top of the tamper tip and with said exposed edge of the inner portion comprising not more than 60 percent of the length of said continuous edge.

3. A tamper tip of abrasion-resistant metal said tamper tip being of generally rectangular shape and having a front surface having an outer generally inverted U-shaped portion having legs tapering from thinner leading edge portions to a thicker top portion forming the base of the "U" with the top of said base forming the top of the tamper tip, an integral inner portion completely filling the interior part of the U-shaped portion, said inner portion having an exposed edge contiguous with and having the same thickness as the leading edges of the legs to provide a continuous edge of constant thickness, with the length of said continuous edge being greater than the distance from said continuous edge to the top of the tamper tip, and with said inner portion being of substantially constant thickness throughout its extent, said tamper tip having a planar back surface extending from said continuous edge to the top of the tamper tip.

4. A tamper tip of abrasion-resistant metal said tamper tip being of generally rectangular shape and having a front surface having an outer generally inverted U-shaped portion having legs tapering from thinner leading edge portions to a thicker top portion forming the base of the "U" with the top of said base forming the top of the tamper tip, an integral inner portion completely filling the interior part of the U-shaped portion, said inner portion having an exposed edge contiguous with and having the same thickness as the leading edges of the legs to provide a continuous edge of constant thickness and with said inner portion being of substantially constant thickness throughout its extent, said tamper tip having a planar back surface extending from said continuous edge to the top of the tamper tip.

* * * * *